US006976320B2

(12) United States Patent
McClaskie

(10) Patent No.: US 6,976,320 B2
(45) **Date of Patent: *Dec. 20, 2005**

(54) METHOD AND APPARATUS FOR IMPROVED SHOE CONSTRUCTION

(75) Inventor: Thomas E. McClaskie, Bethlehem, PA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/676,065

(22) Filed: Oct. 1, 2003

(65) Prior Publication Data

US 2005/0016017 A1 Jan. 27, 2005

Related U.S. Application Data

(63) Continuation-in-part of application No. 10/626,139, filed on Jul. 24, 2003.

(51) Int. Cl.[7] ..... A43B 3/12; A43B 13/28; A43D 21/00

(52) U.S. Cl. ..... 36/11.5; 36/12; 36/16; 36/21; 12/142 C; 12/142 T

(58) Field of Search ..... 36/11.4, 12, 16, 36/18, 19 R, 21, 22 R, 11.5; 12/142 C, 142 T

(56) References Cited

U.S. PATENT DOCUMENTS 967,572 A * 8/1910 Schwander ..... 36/16
2,299,950 A * 10/1942 Sawyer ..... 36/11.5
2,563,092 A * 8/1951 Zacks ..... 36/9 R
2,715,285 A * 8/1955 Del Vecchio ..... 36/44
2,978,817 A * 4/1961 Brenner ..... 36/97
3,583,080 A * 6/1971 Wagner ..... 36/16
4,167,824 A * 9/1979 Wolpa ..... 36/44
4,182,055 A * 1/1980 Turner, Jr. ..... 36/30 R
4,308,671 A * 1/1982 Bretschneider ..... 36/11
4,501,076 A * 2/1985 Dodds ..... 36/11
4,627,179 A * 12/1986 McElroy ..... 36/44
4,685,223 A * 8/1987 Long ..... 36/16
5,644,856 A * 7/1997 Bray, Jr. ..... 36/11.5
6,490,814 B2 * 12/2002 Matis ..... 36/11.5

* cited by examiner

*Primary Examiner*—M. D. Patterson
(74) *Attorney, Agent, or Firm*—St. Onge Steward Johnston & Reens LLC

(57) ABSTRACT

The invention relates to a method and apparatus for providing a sandal or shoe having an outsole with a socklining on top of and in direct contact with the outsole for directly contacting a user's foot and a cushion having a thickness between approximately ⅛ and 1½ inches, where the cushion is placed between said outsole and said socklining. The sandal or shoe also includes at least one material partially covering a user's foot extending across the socklining for holding the sandal onto a user's foot and a securing mechanism extending from the at least one material through the socklining to the outsole for securing the socklining directly to the outsole.

16 Claims, 5 Drawing Sheets

METHOD AND APPARATUS FOR IMPROVED SHOE CONSTRUCTION

PRIORITY APPLICATION

This application is a Continuation in Part patent application of copending U.S. patent application Ser. No. 10/626,139 for a "Method and Apparatus for Improved Shoe Construction" filed Jul. 24, 2003, currently pending.

FIELD OF THE INVENTION

The invention relates to a shoe having improved construction.

BACKGROUND Of THE INVENTION

A variety of different shoe constructions are used by the footwear industry. For the most part, each shoe construction has characteristics that make it particularly well-suited for specific applications. For example, some shoe constructions are selected for their durability, others for their flexibility and comfort, while still others are selected for their aesthetic appeal.

In general, shoe construction typically involves a number of manufacturing operations or steps. Normally, a significant number of manufacturing operations generally results in a more expensive shoe. In a market where competitive price is often desired, there appears to be a need to make shoes in an efficient manner. Conventionally, a shoe construction may involve an upper being stitched to a forepart of an outsole by a hand stitch and the rearpart of the outsole may be attached to the upper by adhesive after a lasting operation. Lasting is typically where a last, an object which simulates a user's foot, is inserted into the upper and the upper is often then pulled taught around the last and secured to a tuck, which is removably attached to the bottom of the last. The tuck generally provides a structure that is adhered to the rearpart of the outsole, which in turn results in the upper being secured to the outsole in the rearpart of the shoe. Without a tuck, it may be difficult to secure the upper to the outsole.

A traditional insole is often wrapped with a wrapper around its peripheral edge to help prevent the edge of the insole from wear. The insole with the wrapper is then typically secured to the tuck or outsole. In a separate operation, a socklining may then be adhered directly to the top of the insole for providing a surface adapted to receive a user's foot because the insole's surface is often coarse.

Another shoe construction, cementing, also often involves a number of manufacturing operations. Cementing components of a shoe, such as the upper to the outsole, typically involves a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another.

Additionally, once the components are pressed together, cementing often requires a waiting period for the cement to cure, or dry. Generally, not only does cementing involve some or all of the above mentioned manufacturing operations, it also involves time, particularly the curing time.

It is believed that the number of steps and time involved, especially if user intervention is required, negatively affects cost and efficiency. The cementing process may be further complicated if the surfaces to be glued are uneven or difficult to reach.

U.S. Pat. Nos. 4,369,589 to Summey ("Summey") and 3,821,827 to Nadler ("Nadler") appear to disclose a shoe having cement or glue to secure the upper to the midsole or outsole. Summey seems to disclose the pressing and aligning operations as well as user intervention described above. Summey also seems to disclose an insole as a part of the shoe.

U.S. Pat. No. 4,685,223 to Long ("Long") seems to relate to a shoe having an upper, socklining, and outsole sewn together. A cushion seems to be enclosed by the socklining and the socklining may in turn be enclosed along a peripheral edge by athe upper. A stitch may secure the socklining and upper to the outsole by penetrating the upper that is folded about the socklining and the peripheral edge of the socklining. Hence, the socklining does not appear to be sewn directly to the outsole.

U.S. Pat. No. 6,029,301 by Issler ("Issler") appears to disclose a shoe having a channel in the bottom surface of the outsole and an upper in contact with a top surface of the outsole, where a stitch passes from the upper to the channel without passing to the bottom surface of the outsole. The channel seems to protect the stitch from wear due to contact between the bottom surface and the ground. However, because the channel appears to be placed within a confined space, dirt, sand, or other debris may get trapped in the space and, as a result, cause wear to the stitch. Moreover, the socklining seems to be adhered to the outsole or cushion, where adhering or gluing the socklining often increases the number of operations and/or cost for constructing the shoe. Furthermore, should the gluing operation prove to be messy, clean up operations may be needed to clean the excess glue.

The sockliner of Issler may be modified to be merely placed on top of the outsole or cushion without adherence. However, in these situations, the sockliner is often attached to a structure, such as a tuck or insole, and the entire unit is then placed on top of the outsole or cushion. Without a tuck or insole, the sockliner may not remain on top of the outsole or cushion as it may tend to slide around due to its lack of structural integrity.

Additionally, in all of the above references, the cushioning appears to extend upwardly into an interior volume of the shoe, which is typically where a user's foot is placed. Because the interior volume is often sized to accommodate the user's foot, increasing the amount of cushioning to enhance comfort may lead to decreased room for the foot. As a result, the foot may be squeezed, leading to a reduced amount of comfort. Therefore, although greater cushioning may be desired, it is often limited due to the amount of interior volume that would typically be sacrificed.

What is desired, therefore, is a shoe that may be constructed in a more efficient manner, including reduced manufacturing costs and less manufacturing operations. What is also desired is a shoe that is efficiently manufactured without sacrificing aesthetic appeal. A further desire is a shoe having enhanced comfort without compromising proper fit.

SUMMARY OF THE INVENTION

Accordingly, it is an object of the invention to provide a shoe with improved construction.

Another object of the invention is to reduce manufacturing costs without sacrificing the shoe quality.

A further object of the invention is to provide a shoe having improved cushioning without negatively affecting proper fit.

Yet another object is to provide a shoe having a notch that hinders premature wear on the stitches that secure the shoe together.

These and other objects of the invention are achieved by a sandal having an outsole with a socklining on top of and in direct contact with the outsole for directly contacting a user's foot and a cushion having a thickness between approximately ⅛ and 1½ inches, where the cushion is placed between said outsole and said socklining. The sandal also includes at least one material partially covering a user's foot extending across the socklining for holding the sandal onto a user's foot and a securing mechanism extending from the at least one material through the socklining to the outsole for securing the socklining directly to the outsole.

In some embodiments, the sandal may include a side surface of the outsole and a notch in the side surface for receiving a stitch and hindering premature wear of the stitch.

In further embodiments, a securing mechanism extends from the socklining to the notch without extending through a bottom surface of the outsole. In yet even further embodiments, the securing mechanism extends from the at least one material, through the socklining, and to the notch, without extending through the bottom surface, for securing the at least one material, the socklining, and the outsole together.

In more preferred embodiments, the thickness of the cushion is between approximately ⅛ and 1 inches. In most preferred embodiments, the thickness of the cushion is between approximately ¼ and 9/16 inches.

Optionally, the notch in the side surface of the outsole may an outermost periphery of the outsole, an inner periphery smaller than the outermost periphery, and a horizontal surface of extending generally perpendicular to and connecting the inner and outermost peripheries together.

In another embodiment, the above limitations may be applied to a shoe rather than a sandal. In still another embodiment, the above limitations may be applied to a sandal without the specific thickness requirements for the cushion.

In another aspect of the invention, a method for providing a shoe includes the step of providing an outsole having a side surface and notching the side surface to provide clearance for a securing mechanism and to hinder the securing mechanism from premature wear. The method also includes contacting a socklining to a top surface of the outsole, placing a cushion between the outsole and the socklining, and extending the securing mechanism from the socklining to the notch, without extending through a bottom surface of the outsole, for securing the socklining directly to the outsole.

Optionally, the method may include the step of providing an upper in direct contact with the socklining, where the securing mechanism extends from the upper, through the socklining, and to the notch, without extending through the bottom surface, for securing the upper, socklining, and outsole together.

In some embodiments, the method further includes notching the bottom surface upwardly into the outsole and around at least one portion of a periphery of the outsole.

In other embodiments, the method may also include the steps of providing an outermost periphery and an inner periphery smaller than the outermost periphery, extending a horizontal surface of the notch generally perpendicular to and connecting the inner and outermost peripheries together, and extending a vertical wall in a generally downward direction proximate to the inner periphery and connecting the horizontal surface of the notch to the bottom surface of the outsole, wherein the horizontal surface of the notch is between the bottom surface of the outsole and a top surface of the outsole.

The invention and its particular features and advantages will become more apparent from the following detailed description considered with reference to the accompanying drawings.

DETAILED DESCRIPTION OF THE DRAWINGS

Figure 1:
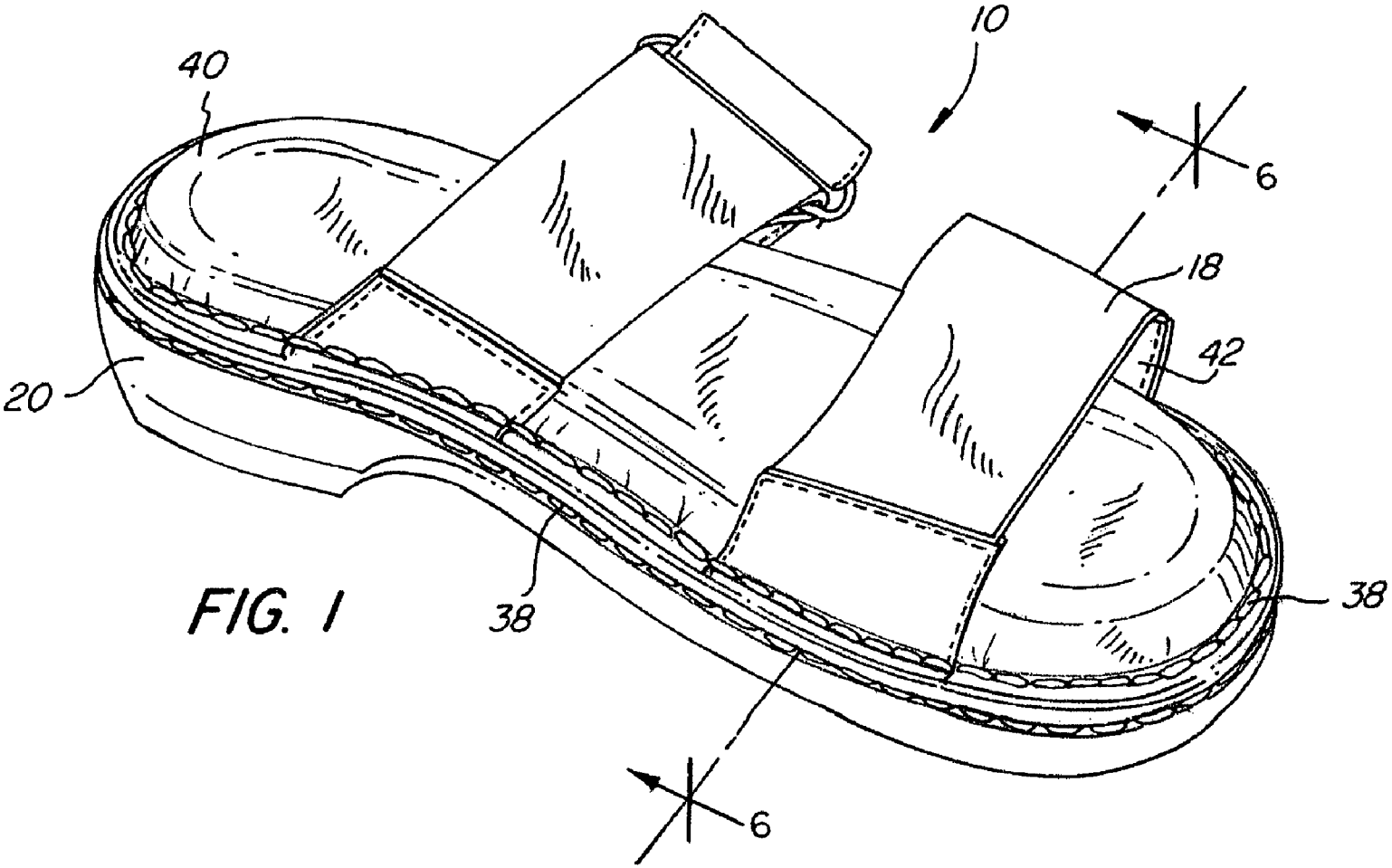
FIG. 1 depicts the shoe in accordance with the invention.

FIG. 1 depicts shoe 10 in accordance with the invention. Shoe 10 includes outsole 20, socklining 40, footbed 62 placed between socklining 40 and outsole 20 for comforting a user's foot, and securing mechanism 38 for securing socklining 40 to outsole 20. Shoe 10 also includes upper 18 for holding the invention onto a user's foot, where the foot is placed in interior volume 42 generally defined between upper 18 and socklining 40.

As shown, shoe 10 is a sandal where upper 18 comprises several straps. In further embodiments, upper 18 is a single strap. In other embodiments, upper 18 extends over, or covers, most of the foot like a sneaker or dress shoe. All that is required is upper 18 comprise at least one material covering a portion of the foot for holding the invention onto a user's foot.

Figure 2:
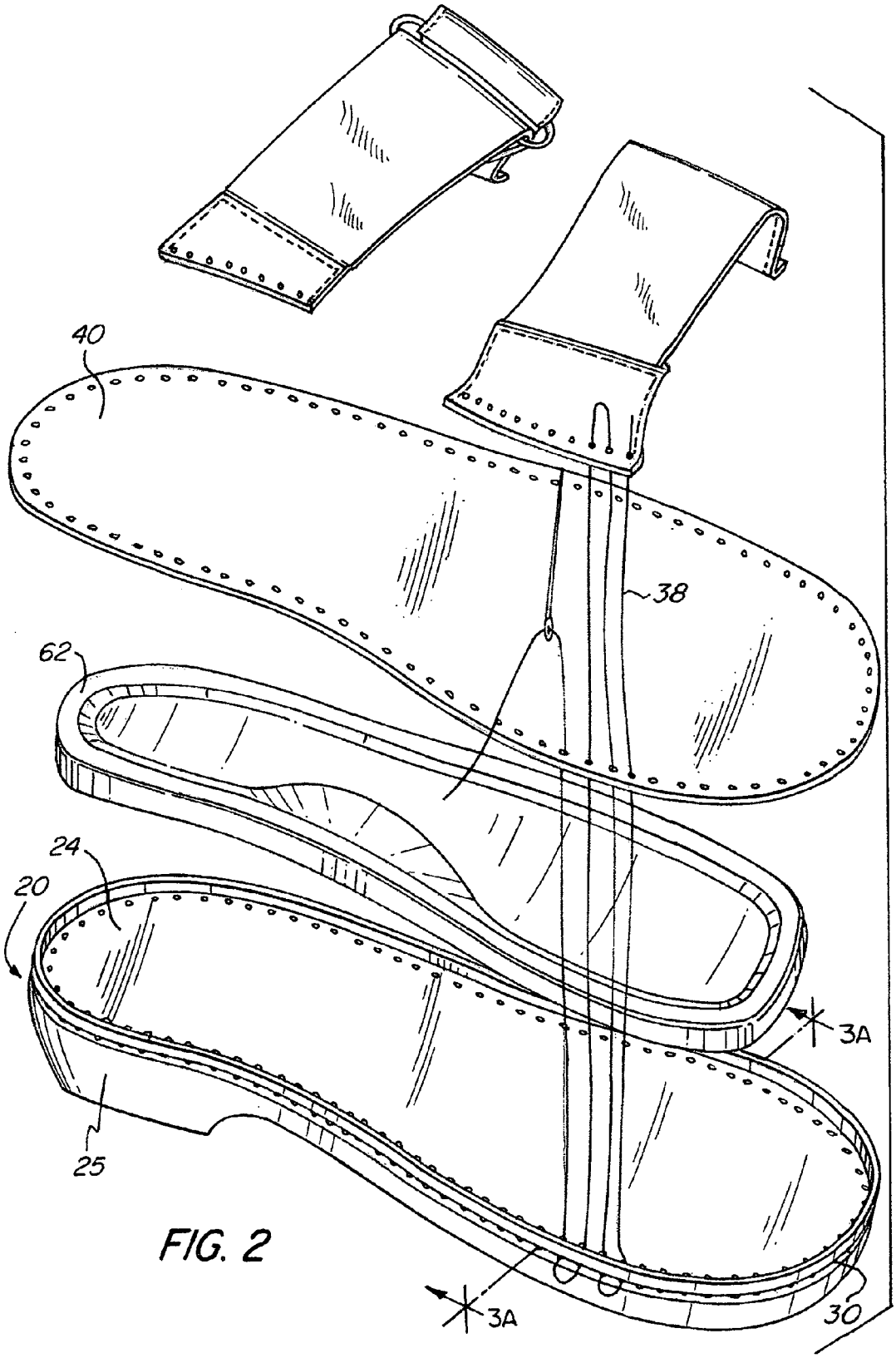
FIG. 2 depicts an assembly view of the components of the shoe shown in FIG. 1.
Figure 3:
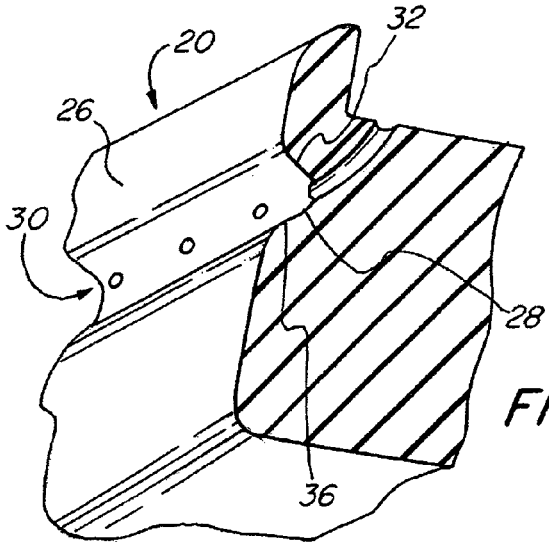
FIG. 3 depicts a close-up view of the outsole shown in FIG. 1.

As shown more particularly in FIGS. 2 and 3, outsole 20 further includes side surface 25, top surface 24, and notch 30. Outsole 20 also includes outermost periphery 26 and inner periphery 28, where inner periphery 28 is smaller than outermost periphery 26.

In the embodiment of notch 30 shown, notch 30 includes horizontal surface 32 extending in a generally perpendicular direction from outermost periphery 26 to inner periphery 28, where horizontal surface 32 connects outermost periphery 26 with inner periphery 28. Notch 30 may optionally include a second horizontal surface 36 having the same limitations as horizontal surface 32. Second horizontal surface 36 completes a notch having three sides, as shown in FIG. 3. In this embodiment, securing mechanism 38 is hindered from wear to a higher degree than the alternative embodiments described below under FIGS. 4*a*–4*d*, where notch 30 includes 2 sides and is without second horizontal surface 36.

Figure 4A:
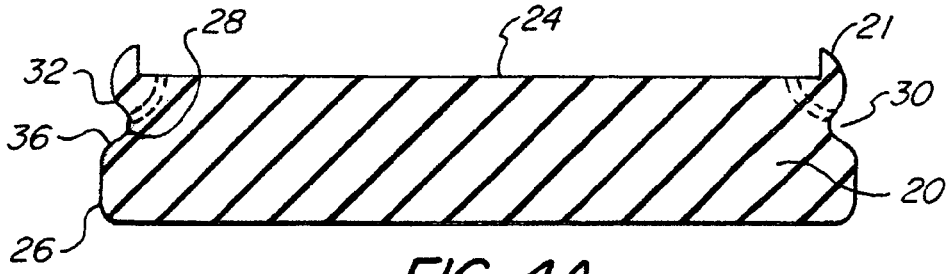
FIGS. 4*a*–4*d* depict various embodiments of the cross section of the outsole shown in FIGS. 1–3.

FIG. 4*a* depicts a cross sectional view of outsole 20 shown in FIGS. 1–3, where outsole 20 includes lip 21 extending around a periphery of outsole 20. Lip 21 and top surface 24 define a cavity for receiving and/or positioning cushion 62. Further, lip 21 provides an anchoring mechanism to which socklining 40 is sewn.

Figure 4B:
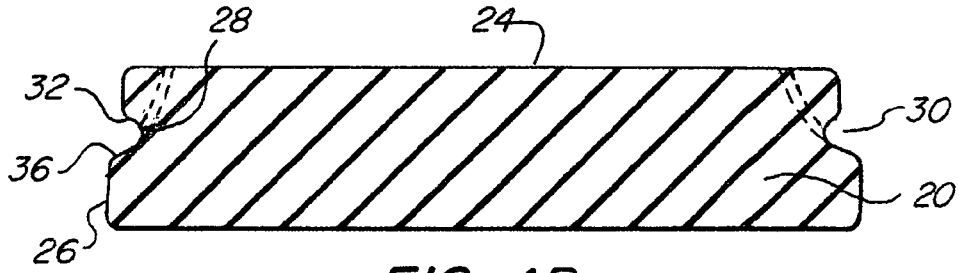

FIG. 4*b* depicts an alternative embodiment of outsole 20 where lip 21 is eliminated because lip 21, although advantageous, is not essential for proper operation of shoe 10. Notch 30 includes horizontal surface 32, outermost periphery 26, inner periphery 28, and second horizontal surface 36.

Figure 4C:
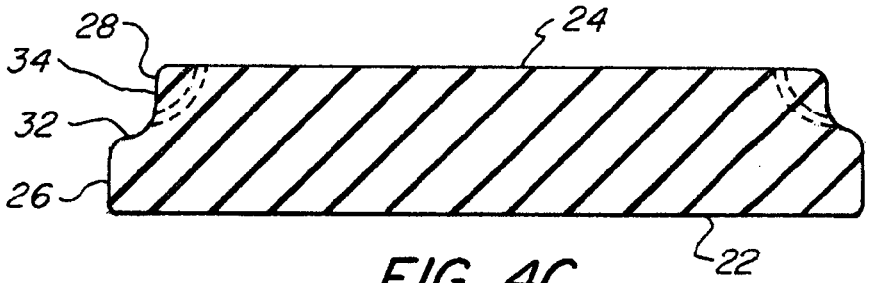
Figure 4D:
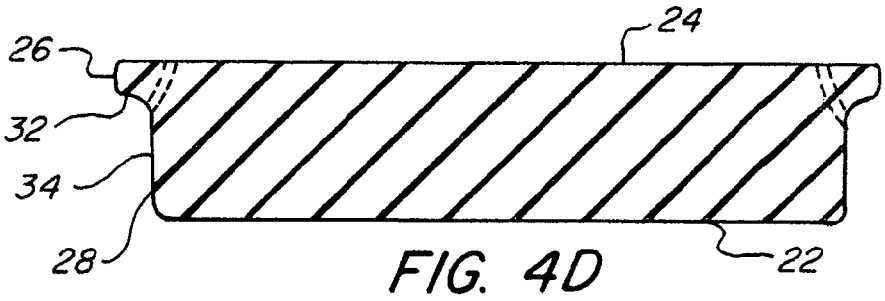

As depicted in FIGS. 4*c*–4*d*, notch 30 is shown in alternative embodiments for hindering securing mechanism 38 from premature wear. Notch 30 is a step-off in FIGS. 4*c*–4*d*. In FIG. 4*d*, notch 30 is a variation of the step-off of that shown in FIG. 4*c*.

In FIG. 4*c*, notch 30 includes horizontal surface 32, outermost periphery 26, and inner periphery 28 having the same limitations as described above under FIG. 3. As shown in FIG. 4*c*, notch 30 does not include second horizontal surface 36 but has vertical wall 34 extending in a generally upward direction in a proximate location to inner periphery 28 for connecting horizontal surface 32 of notch 30 and top surface 24 of outsole 20. As shown, horizontal surface 32 of notch 30 is between bottom surface 22 and top surface 24 of outsole 20.

As shown in FIG. 4*c*, notch 30 is a step-off in top surface 24. However, in further embodiments, notch 30 is any recess, indentation, relief, channel, groove, or etching in side surface 25 of outsole 20 sufficient to provide clearance for securing mechanism 38 such that wear upon securing mechanism 38 is inhibited or reduced. Notch 30 may be formed or manufactured using any known or novel methods or equipment, such as machining, molding, grinding, etching, laser cutting, or the like.

As shown in FIG. 4*d*, notch 30 is also a step-off and is a variation of the step-off shown in FIG. 4*c*. Notch 30 of FIG. 4*d* includes horizontal surface 32, outermost periphery 26, and inner periphery 28 having the same limitations as described above under FIGS. 3 and 4*c*. As shown in FIG. 4*d*, notch 30 does not include second horizontal surface 36 but has vertical wall 34 extending in a generally downward direction in a proximate location to inner periphery 28 for connecting horizontal surface 32 of notch 30 and top surface 24 of outsole 20.

As shown in FIGS. 4*c* and 4*d*, notch 30 extends inwardly toward a center of outsole 20 without surrounding securing mechanism 38 on at least one horizontal side. In this manner, debris or dirt may have difficulty collecting in notch 30 because notch 30 lacks a horizontal wall, where more than one horizontal or side wall may permit debris to collect between the horizontal walls.

Figure 5:
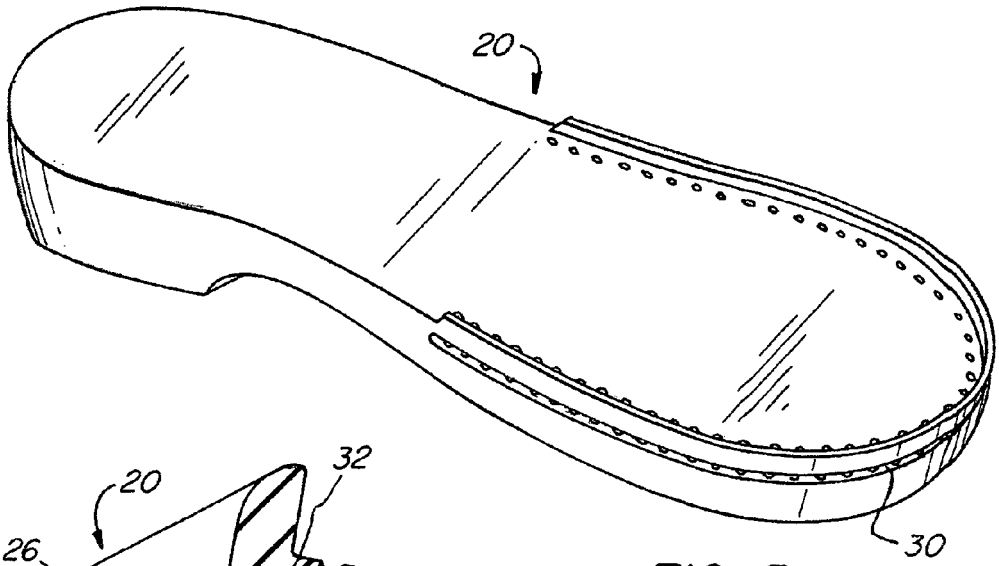
FIG. 5 depicts an alternative embodiment of the outsole shown in FIGS. 1–3.

Although notch 30 is shown in FIGS. 1–3, 4*c*, and 4*d* to continuously extend around an entire periphery of outsole 20, it is not necessary for the invention to function properly. In an alternative embodiment, shown in FIG. 5, notch 30 and lip 21 extend around a portion of the periphery of outsole 20. All that is required of notch 30 is that it provide clearance for securing mechanism 38 so that wear on securing mechanism 38 is inhibited.

Figure 6:
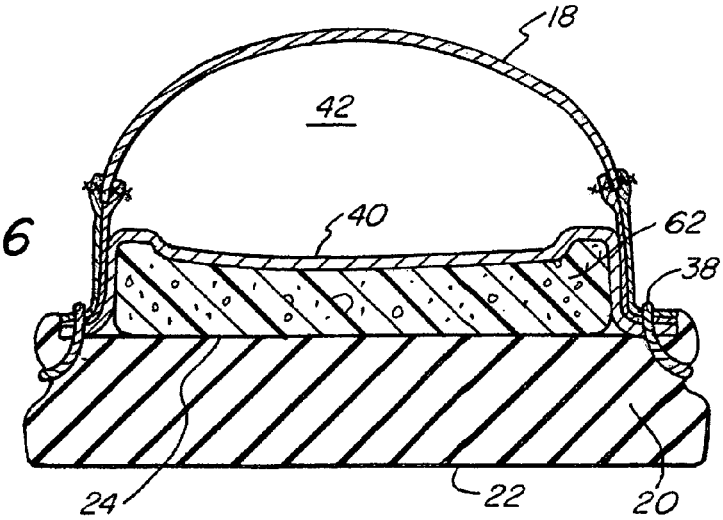
FIG. 6 depicts a cross sectional view of the shoe shown in FIG. 1.

As shown in FIGS. 2 and 6, socklining 40 is in direct contact with top surface 24 of outsole 20. Moreover, socklining 40 is secured to top surface 24 by securing mechanism 38 extending from socklining to notch 30, without extending to bottom surface 22 of outsole 20. In this manner, socklining 40 need not be glued or adhered to top surface 24 of outsole 20, resulting in shoe 10 being made more efficiently. By extending securing mechanism 38 through upper 18, socklining 40, and to notch 30, shoe 10 is completed without a need for an insole, footbed or cushion, or tuck. This results in shoe 10 being manufactured more efficiently with less operations.

One advantage shoe 10 provides over traditional shoe constructions is that socklining 40 is secured as upper 18 is secured to outsole 20, obviating later operations for securing socklining 40. In some embodiments, securing mechanism 38 may pass through upper 18, socklining 40, and notch 30 in a single sewing operation to further enhance efficiency.

As shown in FIGS. 2 and 6, cushion 62 differs from traditional cushions in that cushion 62 is generally thicker, and preferably several times thicker, than those conventionally used. The thickness of cushion 62 is between approximately ⅛ and 1½ inches. More preferably, cushion 62 has a thickness of between approximately ⅛ and 1 inches. Most preferably, thickness of cushion 62 is between approximately ¼ and 9/16 inches. Hence, cushion 62 provides enhanced comfort to the user's foot. Also, because shoe 10 is made approximately 3–5 times larger than traditional sandals or shoes, including an unusually enlarged upper 18 and interior volume 42, cushion 62 does not encroach into interior volume 42 to uncomfortably squeeze the user's foot, which would typically be the result of using cushion 62 in traditional shoes. Therefore, cushion 62 of shoe 10 is not merely a design change from traditional cushions because such size and/or thickness of cushion would negatively affect the comfort of traditional shoes.

Figure 7:
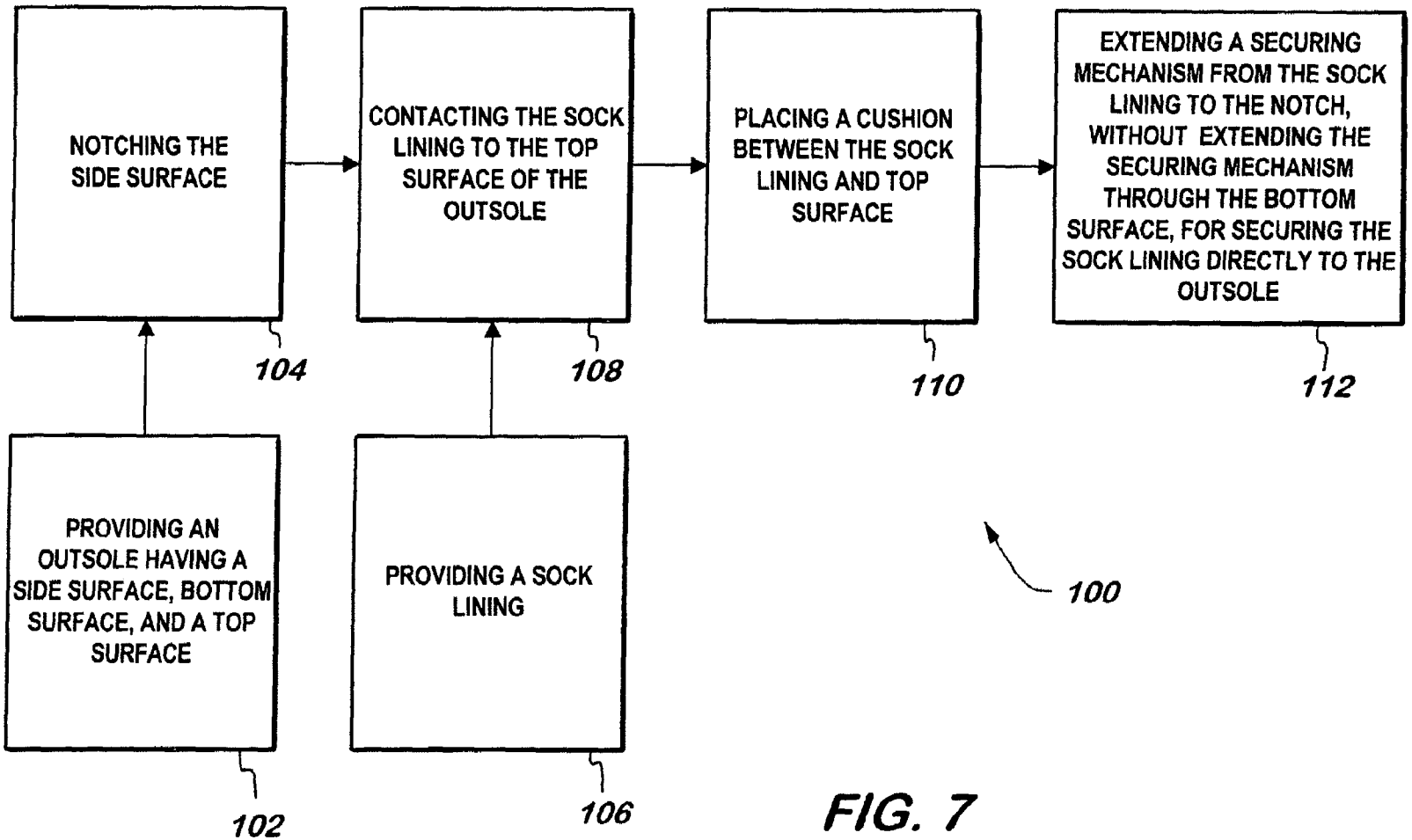
FIG. 7 depicts a method for providing the shoe shown in FIG. 1.

In another aspect of the invention, a method 100 for providing shoe 10 is shown in FIG. 7.

Method 100 includes the step of providing 102 an outsole having a side surface, a bottom surface for contacting the ground, and a top surface. Method 100 also includes notching 104 the side surface to provide clearance for a securing mechanism, where the notched bottom surface will hinder the securing mechanism from premature wear due to the bottom surface contacting the ground.

Method 100 further includes the steps of providing 106 a socklining and contacting 108 the socklining to the top surface of the outsole. Optionally, method 100 may include placing 110 a cushion between the socklining and the top surface of the outsole.

To secure the socklining to the outsole, method 100 extends 112 the securing mechanism from the socklining to the notch, without extending the securing mechanism through the bottom surface, for securing the socklining directly to the outsole. The securing mechanism does not extend through the optional cushion, but the cushion is held in place by being sandwiched between the socklining, outsole, and securing mechanism that extends from the socklining to the notch.

In some embodiments, method 100 optionally provides an upper in direct contact with the socklining and extending the securing mechanism from the upper, through the socklining, and to the notch, without extending through the bottom surface, for securing the upper, socklining, and outsole together.

In further embodiments, method 100 includes the step of providing an outermost periphery and an inner periphery smaller than the outermost periphery, extending a horizontal surface of the notch generally perpendicular to and connecting the inner and outermost peripheries together. In still further embodiments, method 100 may optionally include extending a vertical wall in a generally downward direction proximate to the inner periphery and connecting the horizontal surface of the notch to the top or bottom surface of the outsole, wherein the horizontal surface of the notch is between the bottom surface of the outsole and a top surface of the outsole.

In alternative embodiments, instead of notching 104 the side surface around an entire periphery of the outsole, method 100 notches the side surface around at least one portion of a periphery. Hence, the securing mechanism likewise does not extend around the entire periphery of the shoe but only in the areas of the notches.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A sandal that is open over a user's toe, comprising:

an outsole having a flat top surface that extends from a front part to a rear part and from a left side to a right side;

a socklining on top of and in direct contact with said flat top surface for directly contacting a user's foot;

a cushion having a thickness between approximately ⅛ and 1½ inches;

said cushion is placed between said flat top surface and said socklining;

a material partially covering a user's foot extending across said socklining for holding the sandal onto a user's foot without extending over the toes; and a securing mechanism extending from said material through said socklining to said outsole for securing said socklining directly to said flat top surface.

2. The sandal according to claim 1, wherein said outsole includes a side surface and a notch in said side surface for receiving said securing mechanism and hindering premature wear of said securing mechanism.

3. The sandal according to claim 2, where said securing mechanism extends from said socklining to said notch without extending through a bottom surface of said outsole.

4. The sandal according to claim 2, said securing mechanism extends from said at least one material, through said socklining, and to said notch, without extending through said bottom surface, for securing said at least one material, said socklining, and said outsole together.

5. The sandal according to claim 2, wherein said notch is a relief extending inwardly toward said outsole and around at least a portion of a periphery of said outsole.

6. The sandal according to claim 2, wherein said notch includes an outermost periphery of said outsole, an inner periphery smaller than said outermost periphery, and a horizontal surface of said notch extending generally perpendicular to and connecting said inner and outermost peripheries together.

7. The sandal according to claim 1, wherein said thickness is between approximately ⅛ and 1 inches.

8. The sandal according to claim 1, wherein said thickness is between approximately ¼ and 9⁄16 inches.

9. A shoe that is open over a user's toes, comprising:

an outsole;

a socklining on top of and in direct contact with said outsole for directly contacting a user's foot;

a cushion having a thickness between approximately ⅛ and 1½ inches;

said cushion is placed between said outsole and said socklining;

a material partially covering a user's foot extending across said socklining for holding the sandal onto a user's foot without extending over the toes;

a securing mechanism extending from said socklining to said outsole for securing said socklining directly to said outsole; and said outsole includes a side surface and a notch in said side surface for receiving said securing mechanism and hindering premature wear of said securing mechanism;

said securing mechanism extending around an entire periphery of said outsole and said socklining.

10. The shoe according to claim 9, further comprising an upper in direct contact with said socklining.

11. The shoe according to claim 9, wherein said outsole includes a notch, said notch includes an outermost periphery of said outsole, an inner periphery smaller than said outermost periphery, and a horizontal surface of said notch extending generally perpendicular to and connecting said inner and outermost peripheries together.

12. The shoe according to claim 11, said securing mechanism extends from said at least one material, through said socklining, and to said notch, without extending through said bottom surface, for securing said at least one material, said socklining, and said outsole together.

13. A method for providing a sandal that is open over a user's toes, comprising the steps of:

providing an outsole having a side surface;

notching the side surface to provide clearance for a securing mechanism and to hinder the securing mechanism from premature wear;

contacting a socklining directly to a top surface of the outsole;

placing a cushion having a thickness between approximately ⅛ and 1½ inches between the outsole and the socklining;

extending a material across the socklining for holding the sandal onto a user's foot without extending over the toes; and extending the securing mechanism from the socklining to the notch, without extending through a bottom surface, for securing the socklining directly to the outsole.

14. The method according to claim 13, further comprising the step of providing an upper in direct contact with the socklining, where the securing mechanism extends from the upper, through the socklining, and to the notch, without extending through the bottom surface, for securing the upper, socklining, and outsole together.

15. The method according to claim 13, further comprising the step of notching the bottom surface upwardly into the outsole and around at least one portion of a periphery of the outsole.

16. The method according to claim 13, further comprising the step of providing an outermost periphery and an inner periphery smaller than the outermost periphery, extending a horizontal surface of the notch generally perpendicular to and connecting the inner and outermost peripheries together, and extending a vertical wall in a generally downward direction proximate to the inner periphery and connecting the horizontal surface of the notch to the bottom surface of the outsole, wherein the horizontal surface of the notch is between the bottom surface of the outsole and a top surface of the outsole.

* * * * *